US006688113B1

(12) United States Patent
Kunimoto et al.

(10) Patent No.: US 6,688,113 B1
(45) Date of Patent: Feb. 10, 2004

(54) SYNTHETIC FELT REGENERATOR MATERIAL FOR STIRLING CYCLE CRYOCOOLERS

(75) Inventors: Wallace Y. Kunimoto, Goleta, CA (US); Arturo Soto, Oxnard, CA (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 0 days.

(21) Appl. No.: 10/364,068

(22) Filed: Feb. 11, 2003

(51) Int. Cl.[7] ..... F25B 9/00; F23L 15/02; F28D 17/00; F28D 19/00

(52) U.S. Cl. ..... 62/6; 165/4; 165/10

(58) Field of Search ..... 62/6; 165/4, 10

(56) References Cited

U.S. PATENT DOCUMENTS

| | | | | |
|---|---|---|---|---|
| 3,062,509 A | * | 11/1962 | Mulder | 165/10 |
| 3,456,718 A | * | 7/1969 | DeFries | 165/10 |
| 4,835,973 A | | 6/1989 | Jones et al. | 62/6 |
| 4,928,658 A | | 5/1990 | Ferrenberg et al. | 123/543 |
| 5,337,563 A | | 8/1994 | Weber | 60/520 |
| 5,429,177 A | | 7/1995 | Yaron et al. | 165/10 |
| 6,474,075 B1 | * | 11/2002 | Tanaka et al. | 62/6 |
| 6,475,935 B1 | * | 11/2002 | Ishizaki et al. | 442/188 |
| 2002/0139510 A1 | * | 10/2002 | Ishizaki | 165/10 |
| 2003/0000226 A1 | * | 1/2003 | Amano | 62/6 |

FOREIGN PATENT DOCUMENTS

WO WO-03-004945 * 1/2003

OTHER PUBLICATIONS

Lewis, M.A., et al., "Measurement of Heat Conduction Through Metal Spheres", Cryocoolers 11, 2001, pp. 419–425.

Radebaugh, Ray et al., "Regenerator Behavior with Heat Input or Removal at Intermediate Temperatures", Cryocoolers 11, 2001, pp 409–418.

Tuchinskiy, L. et al., "Innovation Technology of Low Temperature Regenerators", Cryocoolers 11, 2001, pp 427–432.

* cited by examiner

*Primary Examiner*—William C. Doerrler
(74) *Attorney, Agent, or Firm*—O'Melveny & Myers

(57) ABSTRACT

A regenerator material for use inside a displacer of a Stirling cycle cryocooler includes a plurality of circular disks formed from a synthetic felt that is preferably polyester. The plurality of disks have an outer diameter that is greater than the inner diameter of the displacer. The plurality of circular disks form a stack within the displacer. The regenerator material minimizes operational variation between different cryocoolers. In addition, the regenerator material can be easily filled into the cryocooler displacer.

11 Claims, 4 Drawing Sheets

SYNTHETIC FELT REGENERATOR MATERIAL FOR STIRLING CYCLE CRYOCOOLERS

FIELD OF THE INVENTION

The present invention is generally directed to regenerators for use in regenerative gas cycle cryocoolers and refrigerators. More particularly, the present invention is directed to regenerator materials used in connection with Stirling cycle cryocoolers.

BACKGROUND OF THE INVENTION

Regenerative gas cycle cryocoolers, and in particular, Stirling cycle cryocoolers have increasingly been employed to achieve low cryogenic temperatures for a variety of applications in different fields. One particular application for Stirling cycle cryocoolers relates to the cooling of high temperature superconducting (HTS) materials. HTS materials are used in a number of applications including, for example, in front-end filters used in wireless telecommunications.

Stirling cycle cryocoolers offer a number advantages over other types of cryocoolers. First, the Stirling cycle is a thermodynamically efficient cycle that requires a relatively small amount of power to achieve cryogenic temperatures. Stirling cycle cryocoolers can also be manufactured into a relatively compact size. Moreover, the necessary components needed for the Stirling cycle can be economically incorporated into a cryocooler. Finally, Stirling cycle cryocoolers provide a long operating life that exceeds that of other more conventional cryocoolers.

Stirling cycle cryocoolers operate in a closed thermodynamic cycle in which a working gas such as helium is alternatively compressed and expanded using one or more pistons contained within a cylinder. In one design, Stirling cycle cryocoolers may contain two moving pistons (an expansion piston and a compression piston) as well as a stationary regenerator material. In another design, the so-called free piston Stirling cycle cryocooler, uses a single cylindrical expansion piston that contains the regenerator material, herein referred to as a "moving displacer". In either design, however, the regenerator material acts as a heat exchanger for the working fluid. In one portion of the Stirling cycle, the regenerator absorbs heat from the working fluid (i.e., helium gas) while in another portion of the Stirling cycle, the regenerator releases heat to the working fluid.

For high performance, the regenerator material should be thermally insulating in the axial direction (i.e., in the direction of the thermal gradient) while at the same time be able to exchange heat rapidly with the working fluid. Several types of regenerators have been used in the past in conjunction with Stirling cycle cryocoolers including beds of packed spheres, stacked layers of fine gauge metal wire, metal foils, steel wool, steel felt, and parallel plates with flow passages. It is also known that polyester such as pillow batting can be used as the regenerator material. With respect to the use of polyester as the regenerator material, it is known to pack the polyester into a moving displacer within a free piston Stirling cycle cryocooler using a series of "wads" or "balls" of polyester.

When wads or balls of polyester are used, the displacer must be manually packed with the appropriate number of wads or balls for each cryocooler. This process, however, is extremely labor intensive and adversely impacts the yield and performance of the completed cryocoolers due to variations in the packing uniformity from cryocooler to cryocooler.

In some cryocoolers, the wads or balls are packed tightly while in others the wads or balls are packed loosely along the length inside the displacer. This packing problem, produces varying heat acceptor temperatures (i.e., cold end temperatures) for a given power input. Similarly, if a constant cold end temperature is desired, different cryocoolers with differing packing characteristics will have different power input demands. A need exists for a regenerator material that will produce constant or near constant cold end temperatures in differing cryocoolers that are powered by the same input power.

Another problem with using wads or balls of polyester is that there are interstitial spaces or gaps between the wads/balls that allow the working fluid to easily pass through without any heat exchange. This is particularly troublesome at the interface between the regenerator material and the inner diameter of the displacer where working fluid may readily pass along in the axial direction with little or no interaction with the regenerator material. These spaces or gaps can also create unwanted variations in cryocooler performance. There is thus a need for a regenerator material that will prevent these adverse variations in performance between different cryocoolers caused by gaps or spaces located within the regenerator material.

Finally, packing the wads or balls of polyester within the displacer of a Stirling cycle cryocooler requires considerable force to achieve the optimum packing density of polyester. The packing of the wads/balls, however, has traditionally been accomplished by hand (i.e., during manufacturing of the cryocooler, a person manually stuffs the displacer with the wads/balls of polyester) into the displacer and requires persons of considerable strength to force all of the polyester wads/balls into the displacer. Some people working on the manufacturing line simply do not have the strength to pack the polyester wads/balls into the displacer in a timely fashion if at all. Accordingly, there is a need for a regenerator material that can be loaded by any person in the manufacturing line—not just those individuals with extraordinary strength.

SUMMARY OF THE INVENTION

In a preferred embodiment of the invention, a regenerator material for use inside the moving displacer of a Stirling cycle cryocooler includes a plurality of circular disks formed from a synthetic felt. The plurality of circular disks form a stack within the displacer of the Stirling cycle cryocooler. The plurality of circular disks have outer diameters that are greater than the inner diameter of the displacer. It is preferable that the synthetic felt be made of polyester but other materials may be used such as, for example, polytetrafluoroethylene, polyimide, and polyamide.

In another aspect of the invention a method of filling a displacer with a regenerator material comprises the steps of forming a synthetic felt, punching out a plurality of disks out of the felt, wherein each of the plurality of felt disks have an outer diameter that is greater than the inner diameter of the displacer, loading the plurality of felt disks into the interior of the displacer, and closing the displacer.

It is an object of the invention to provide a regenerator material that can be used inside a displacer of a Stirling cycle cryocooler. It is a further object of the invention to provide a regenerator material that can be easily packed within the inside of a displacer. It is another object of the invention to provide a regenerator material that minimizes performance variations between different packed cryocoolers. It is yet another object of the invention to provide a regenerator material that prevents the unobstructed flow of working fluid through the regenerator in the axial direction. Other objects of the invention are described in detail below.

BRIEF DESCRIPTION OF THE DRAWINGS

FIG. 2(*b*) is a side view of the single circular disk of regenerator material of FIG. 2(*a*).

DESCRIPTION OF THE PREFERRED EMBODIMENTS

Figure 1:
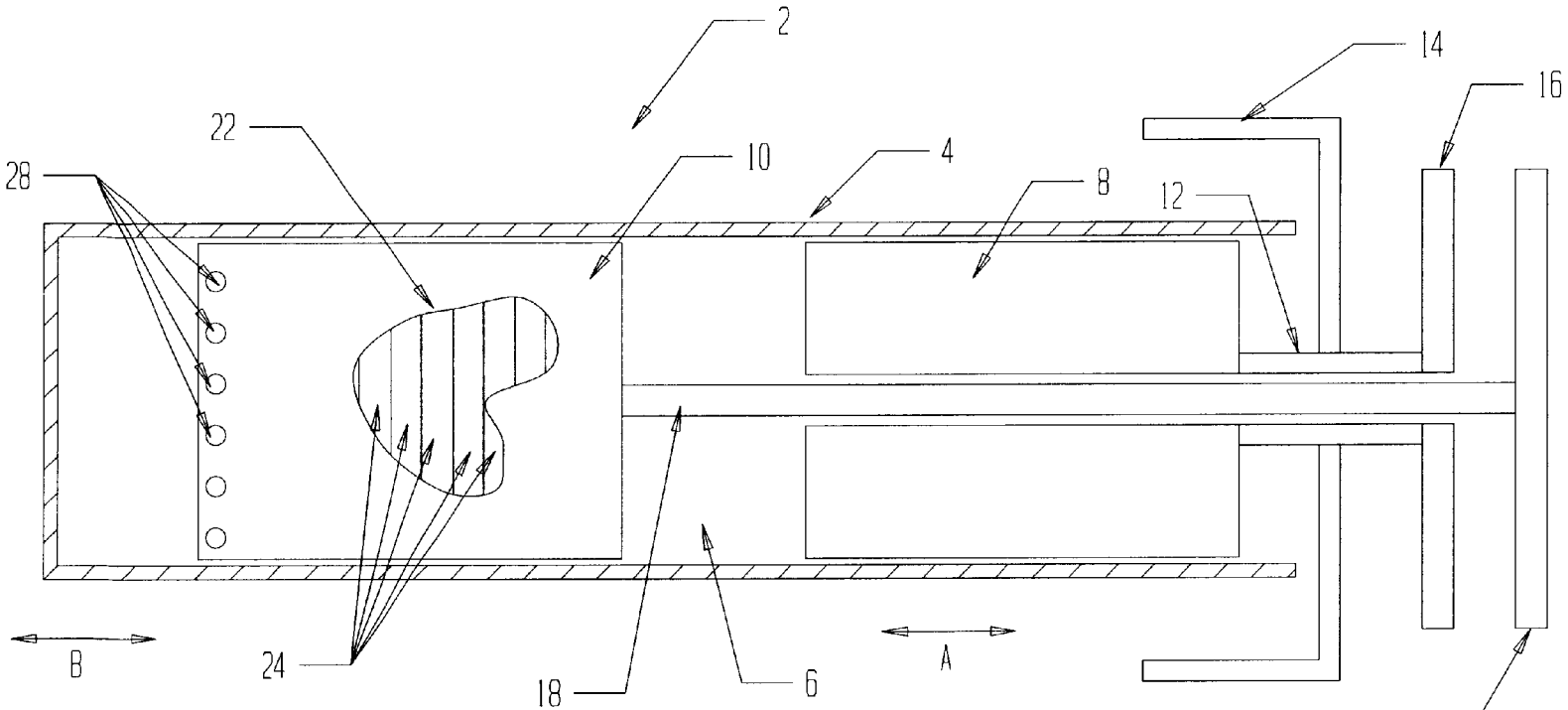
FIG. 1 illustrates a free piston Stirling cyrocooler according a preferred embodiment of the invention.

FIG. 1 illustrates the core components of a Stirling cycle cryocooler 2. The cryocooler 2 includes a cylinder 4 that contains therein a working fluid 6 such as helium. Inside the cylinder 4 are a moveable compression piston 8 and a moveable displacer 10. The working fluid 6 is sealed within the cylinder 4 and is alternately compressed and expanded by movement of the piston 8 and displacer 10. The cylinder 4 is fixed in place (stationary) and the displacer 10 and piston 8 move back and forth within the cylinder 4 (in the direction of arrow A). The displacer 10 moves back and forth in the direction of arrow B which is the same direction as arrow A but travels out of phase with the piston 8.

Still referring to FIG. 1, the piston 8 is attached to a piston rod 12 which in turn is secured to a magnet ring 14. The magnet ring 14 is driven back and forth in the direction of arrow A using a linear motor (not shown) that is powered by alternating current. The movement of the magnet ring 14 causes corresponding movement of the piston 8. The terminal end of the piston rod 12 is fastened to a first flexure spring 16.

The displacer 10 is connected to its own separate displacer rod 18 which then passes through the piston 8 and the associated piston rod 12. The displacer rod 18 is affixed to a second flexure spring 20 that is located rearward of the first flexure spring 16. The displacer 10 moves back and forth in the direction of arrow B due to fluid pressure variation caused by the movement of the piston 8, flexure spring constant, fluid pressure drops, etc. within the cylinder 4. Consistent with the operation of free piston Stirling cycle cyrocoolers 2, movement of the displacer 10 is out of phase with the movement of the piston 8. Preferably the piston 8 is run out of phase with respect to the displacer 10 by about +40° to about +60°. As seen in FIG. 1, the cryocooler 2 is designed as a free piston Stirling cycle cryocooler 2. In this preferred design, the piston 8 is not mechanically linked to the displacer 10 and is driven by the same linear motor.

The displacer 10 is in the form of an enclosed hollow cylinder and contains a regenerator material 22 therein (shown in partial cut-away view in FIG. 1). The regenerator material 22 is preferably formed using a plurality of circular disks 24 made from a synthetic non-woven felt.

Figure 2A:
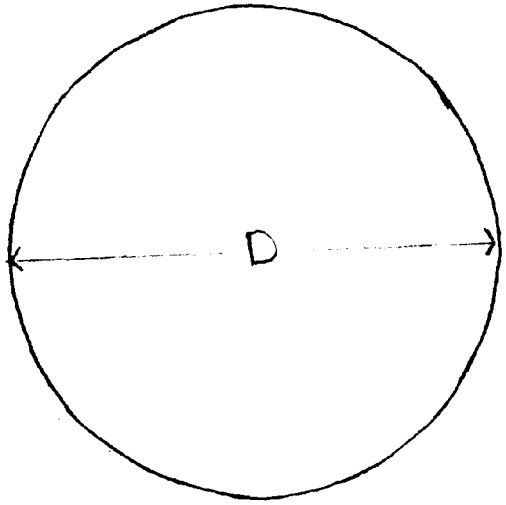
FIG. 2(*a*) is a plan view of a single circular disk of regenerator material according to a preferred embodiment of the invention.
Figure 2B:
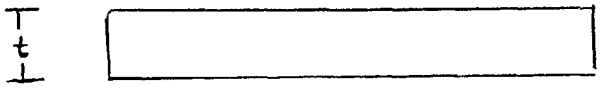

FIG. 2(*a*) illustrates a top plan view of a single felt disk 24. FIG. 2(*b*) illustrates a side view of the felt disk 24 shown in FIG. 2(*a*). As seen in FIGS. 2(*a*) and 2(*b*), the felt disk 24 has a diameter D and a thickness t. Preferably, the diameters D of the felt disks 24 used in forming the regenerator 22 is slightly larger than the internal diameter of the displacer 10. The diameters D of the felt disks 24 are larger so that each disk 24 fits snugly within the interior of the displacer 10. Because the inside of the displacer 10 and thus the disks 24 are exposed to cryogenic temperatures and undergo some thermal shrinkage, the disks 24 should be sized such that their circumferences always touches the inner wall of the displacer 10 at cryogenic temperatures. This will ensure that helium gas will not travel unimpeded from one end of the displacer 10 to the other along the inner wall of the displacer 10.

Preferably, the felt disks 24 are formed from a synthetic material such as polyester. Polyester is a manufactured fiber in which the fiber-forming substance is any long chain synthetic polymer composed of at least 85% by weight of an ester of a substituted aromatic carboxylic acid, including but not limited to substituted terephthalate units,

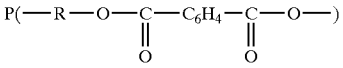

and para substituted hydroxy-benzoate units,

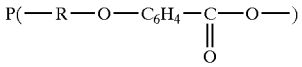

wherein the fiber is formed by the interaction of two or more chemically distinct polymers (of which none exceeds 85% by weight), and contains ester groups as the dominant functional unit (at least 85% by weight of the total polymer content of the fiber), and which, if stretched at least 100%, durably and rapidly reverts substantially to its unstretched length when tension is removed. See Federal Trade Commission (FTC) definition, 16 CFR § 303.7.

Even more preferable, the synthetic material is made from polyethylene terephthalate (PET). In particular, it is preferable to use felt formed from 6 denier PET fiber. This preferred fiber may be obtained from KOSA (type 295 6 denier) at P.O. BOX 10004, Spartanburg, S.C. 29304–4004. The fiber is then made into a non-woven felt using conventional felt processes. The felt may be obtained, for example, from Hollinee Felt, 28001 W. Concrete Drive, Ingleside, Ill. 60041.

While the preferred embodiment of the invention uses PET for the felt fiber there are other materials that may also be used to form the synthetic felt. For example, the fibers forming the felt disks 24 may be made out of polytetrafluoroethylene, polyamide (e.g., nylon), or polyimide. Still other synthetic fibers may also be used provided that the fibers are still ductile at cryogenic temperatures (i.e., around 40 K to around 150 K) and the fibers have acceptable specific heat values and very low thermal conductivity values.

It is preferable to clean the disks 24 to ensure that contaminants are not deposited within the moving components of the cyrocooler 2. Once the felt is obtained, the felt disks 24 are produced by mechanically punching out individual disks 24. The felt disk 24 is then cleaned in an ultrasonic cleaner using a water-based detergent. The felt is then heated below its melting temperature until the material is completely dry. As stated above, the punch is chosen to produce disks 24 that have an outer diameter D that is greater than the inner diameter of the displacer 10.

After the felt disks 24 are punched, the individual felt disks 24 are loaded into the displacer 10. For manufacturing purposes, the number of felt disks 24 required for the displacer 10 is known in advance. As such, the correct number of felt disks 24 can be easily loaded by a single person by simply stacking the correct number of disks 24 inside the displacer. The disks 24 may be required to be tamped down to make sure that there are no voids contained within the displacer 10. In contrast to the manual loading of polyester wads or balls, this method produces a consistent amount of regenerator material 22 within the displacer 10. In addition, the felt disks 24 are easily loaded into the displacer 10. The person loading the disks 24 does not have to forcibly jam the disks 24 inside the displacer 10 as commonly happens when the balls or wads of polyester are used. Finally, the displacer 10 is closed by capping the displacer 10 with a cap (not shown).

Figure 3:
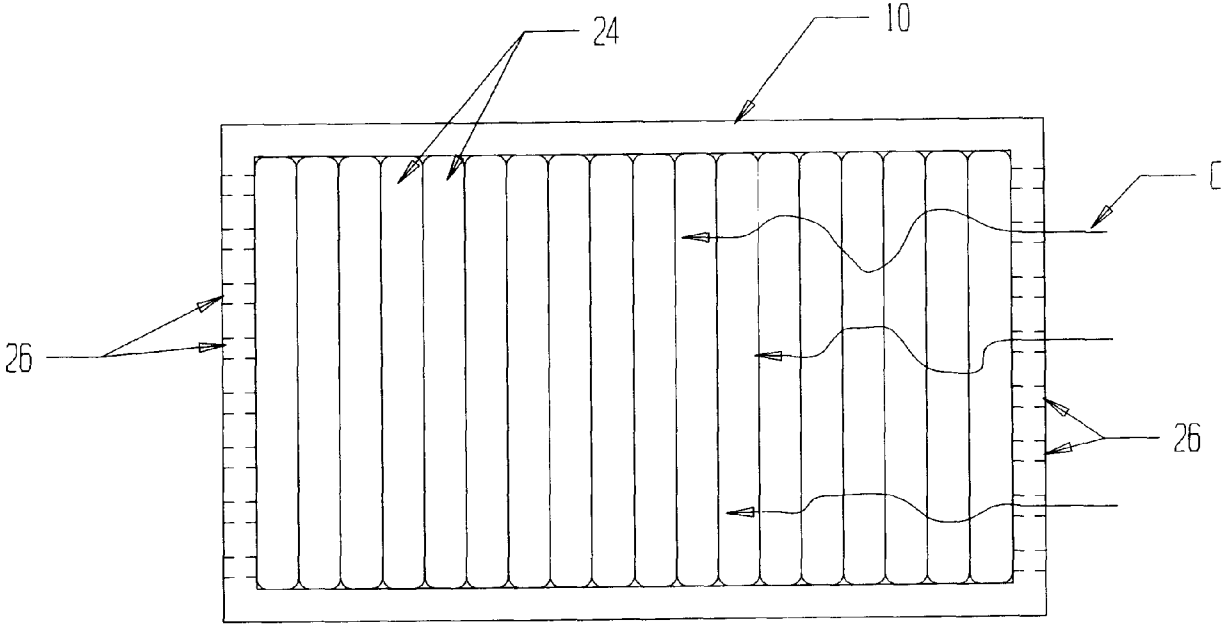
FIG. 3 is a cross-sectional view of a displacer containing a plurality of circular disks of regenerator material.

FIG. 3 illustrates a loaded displacer 10 having eighteen felt disks 24. At either axial end of the displacer 10 are a plurality of holes 26 that permit the working fluid 6 to enter and exit the displacer 10. Arrows C shown in FIG. 3 schematically illustrates the flow of working fluid 6 through the plurality of felt disks 24. The number of disks 24 per displacer 10 can vary depending on the design of the cryocooler 2. Preferably the cryocooler 2 is loaded with a sufficient number of felt disks 24 to achieve the required heat transfer and acceptable pressure drop. With the particular embodiment disclosed herein, it is generally preferable to use between about 15 and about 20 felt disks 24 per displacer 10 with a helium flow rate of 2.2 slpm. As seen in FIG. 1, additional holes 28 may be present at the cold end of the displacer 10 to further aid in heat transfer.

According to a preferred embodiment of the invention, the felt disks 24 have a diameter D of about 17 mm and a thickness t of about 0.25 inches. In addition, it is preferable that the felt disks 24 be manufactured with a synthetic felt having a density of about 32 oz/yd$^2$. It is generally preferred that all of the felt disks 24 contained within the displacer have the same dimensions (i.e., thickness and width) and density.

Those skilled in the art will appreciate that the cryocooler 2 operates with four cycles. The first cycle is constant volume regeneration in which heat contained in the working fluid 6 helium is transferred to the regenerator material 22. In the next stage of the cycle, heat is added from an external source (heat load) thereby causing expansion to take place at nearly constant temperature. Next, heat is transferred from the regenerator material 22 back to the working fluid 6 under constant volume. Finally, the cycle is completed when heat is rejected to an external heat sink under near constant temperature compression.

Experiments were conducted using a free piston Stirling cyrocooler 2 that compared regenerator material 22 formed into felt disks 24 and wads. Both the felt disks 24 and wads were formed from the same type of polyester material and loaded into a displacer 10. Each cryocooler 2 tested was powered with 100 W average input power. In addition, each cryocooler 2 had a 5 W heat load applied to the cold end of the cryocooler 2. Temperature measurements were then taken of the heat acceptor $T_{acc}$ at the cold end of the cryocooler 2.

For the experiments conducted using the felt disks 24, either sixteen or seventeen felt disks 24 were loaded into the displacer 10. The felt disks 24 had a diameter D of 17 mm and a thickness t of 0.25 inches. In addition, the felt disks 24 had a density of 32 oz/yd$^2$. The total weight of the felt disks 24 within the displacer 10 is shown in Table 1 below. Table 1 also shows the measured $T_{acc}$ for each experiment.

TABLE 1

| Experiment No. | # FELT DISKS | WEIGHT (g) | FLOW (slpm He) | LIFT (HEAT LOAD) (W) | $T_{acc}$ (K) | INPUT POWER (W) |
|---|---|---|---|---|---|---|
| 1 | 16 | 4.5 | 2.2 | 5 | 70.1 | 101 |
| 2 | 16 | 4.7 | 2.2 | 5 | 70.4 | 101 |
| 3 | 17 | 4.9 | 2.2 | 5 | 71 | 103 |
| 4 | 16 | 4.5 | 2.2 | 5 | 71.6 | 101 |
| 5 | 16 | 4.5 | 2.2 | 5 | 72.1 | 101 |

In another set of experiments, wads of polyester were used in the displacer 10. For these experiments five wads of regenerator material were loaded into the displacer 10. The total weight of the regenerator wads within the displacer 10 is shown in Table 2 below.

TABLE 2

| Experiment No. | # WADS | WEIGHT (g) | FLOW (slpm He) | LIFT (HEAT LOAD) (W) | $T_{acc}$ (K) | INPUT POWER (W) |
|---|---|---|---|---|---|---|
| 1 | 5 | 5.5 | 2.2 | 5 | 79.1 | 101 |
| 2 | 5 | 5.5 | 2.2 | 5 | 75.4 | 100 |
| 3 | 5 | 5.5 | 2.2 | 5 | 72.9 | 101 |
| 4 | 5 | 5.5 | 2.2 | 5 | 71.4 | 101 |
| 5 | 5 | 5.5 | 2.2 | 5 | 75.9 | 102 |
| 6 | 5 | 5.5 | 2.2 | 5 | 73.4 | 99 |

Figure 4:
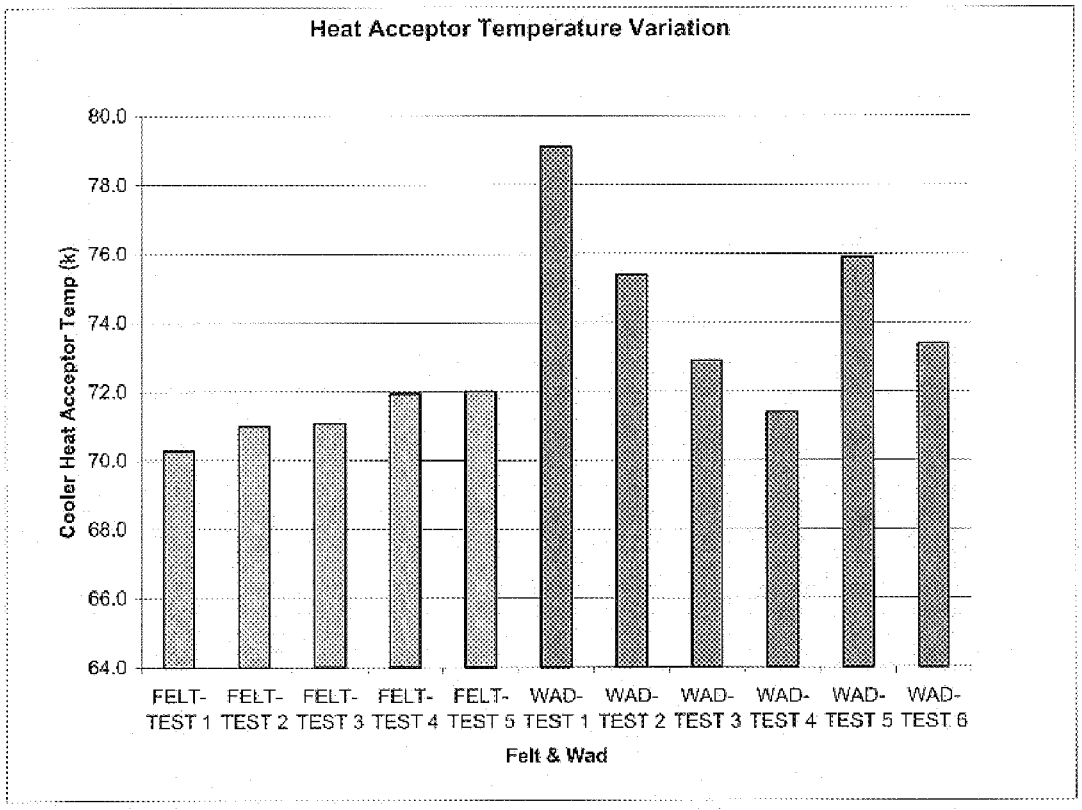
FIG. 4 is a graph showing the heat acceptor temperature variation for wad-filled and synthetic disk-filled cryocoolers.

FIG. 4 illustrates the variation in the measured heat acceptor temperature $T_{acc}$ for the cryocooler 2 packed with felt disks 24 and polyester wads. As seen in FIG. 4, for the cryocooler 2 packed with polyester wads, the measured heat acceptor temperature $T_{acc}$ varied from 71.4 K to 79.1 K, a difference of 7.7 K. This 7.7 K difference in $T_{acc}$ corresponds to about 1 Watt in heat lift variation between the different cryocoolers 2. In contrast, the measured heat acceptor temperature $T_{acc}$ varied from 70.1 K to 72.1 K in the cryocooler 2 packed with felt disks 24—a difference of only 2.0 K. Accordingly, the cryocoolers 2 packed with felt disks 24 exhibited a much more consistent performance with respect to heat acceptor temperature $T_{acc}$ as compared to those packed with wads of polyester. Moreover, as seen in Table 1, Table 2, and FIG. 4, the cryocooler 2 containing the felt disks 24 showed the lowest heat accepter temperatures $T_{acc}$. This indicates that for the same amount of input power the cryocooler 2 with the felt disks 24 can achieve lower cryogenic temperatures and thus is a more efficient cryocooler 2.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A regenerator material for use inside a displacer of a Stirling cycle cryocooler comprising:

a plurality of circular disks consisting of from a synthetic felt, the plurality of disks having an outer diameter that is greater than the inner diameter of the displacer, the plurality of circular disks forming a stack within the displacer of the Stirling cycle cryocooler.

2. The regenerator material of claim 1, wherein the synthetic felt comprises polyester.

3. The regenerator material of claim 2, wherein the synthetic felt comprises polyethylene terephthalate.

4. The regenerator material of claim 1, wherein the synthetic felt comprises polytetrafluoroethylene.

5. The regenerator material of claim 1, wherein the synthetic felt comprises polyimide.

6. The regenerator material of claim 1, wherein the synthetic felt comprises polyamide.

7. The regenerator material of claim 1, wherein each of the plurality of circular disks within the stack has the same density.

8. The regenerator material of claim 3, wherein the synthetic felt contains fibers having diameters of about 6 denier.

9. The regenerator material of claim 7, wherein the density is about 32 oz/yd$^2$.

10. A method of filling a displacer with a regenerator material comprising the steps of:

providing a synthetic felt not including a coating of a rare earth material disposed thereon;

punching a plurality of felt disks out of the felt, each of the plurality of felt disks having an outer diameter greater than the inner diameter of the displacer;

loading the plurality of felt disks into the interior of the displacer; and closing the displacer.

11. The method of filling according to claim 10, further comprising the step of cleaning the synthetic felt prior to the step of loading.

* * * * *